United States Patent [19]

Kanoto et al.

[11] Patent Number: 4,750,729

[45] Date of Patent: Jun. 14, 1988

[54] SHEET LOADING DEVICE

[75] Inventors: Masanobu Kanoto, Tokyo; Jun Saito, Kawasaki; Tadashi Yagi, Yokohama; Yuji Takahashi; Toshio Yoshimoto, both of Tokyo, all of Japan

[73] Assignee: Canon Kabushiki Kaisha, Tokyo, Japan

[21] Appl. No.: 942,965

[22] Filed: Dec. 18, 1986

Related U.S. Application Data

[63] Continuation of Ser. No. 616,705, Jun. 4, 1984, abandoned.

[30] Foreign Application Priority Data

Jun. 10, 1983 [JP] Japan ..... 58-103853
Jun. 15, 1983 [JP] Japan ..... 58-108076

[51] Int. Cl.[4] ..... B65H 1/00

[52] U.S. Cl. ..... 271/162; 271/217; 271/224; 271/314; 414/43

[58] Field of Search ..... 271/207, 213, 217, 218, 271/220, 314, 251, 223, 224, 162, 164, 221, 222, 117; 414/900, 35, 36, 43, 45, 97, 98, 100, 101

[56] References Cited

U.S. PATENT DOCUMENTS 1,863,465 6/1932 Borrowdale ..... 271/217
3,107,912 10/1963 Fiehl ..... 414/43 X
3,905,487 9/1975 Hoke et al. ..... 271/224 X
4,017,066 4/1977 Lasher et al. ..... 271/314
4,504,053 3/1985 Shiozawa ..... 271/162 X

FOREIGN PATENT DOCUMENTS 54-41735 4/1979 Japan .

*Primary Examiner*—Andres Kashnikow
*Assistant Examiner*—Matthew C. Graham
*Attorney, Agent, or Firm*—Fitzpatrick, Cella, Harper & Scinto

[57] ABSTRACT

This invention relates to a sheet loading device for causing sheets put out one after another from a sheet output apparatus such as a laser beam printer or a copying apparatus onto a sheet receiving member to be loaded in orderly, mutually superposed relationship without being deviated from one another. The sheet loading device is provided with a sheet receiving member for supporting thereon discharged sheets in mutually superposed relationship, a sheet loading positioning member, gathering device for frictionally contacting the upper surface of the sheets supported on the sheet receiving member and gathering the sheets in an oblique direction, and a support member free to move and position and supporting the gathering device and the positioning member, and is characterized in that the support member is moved in accordance with the size of the sheets put out onto the sheet receiving member to thereby position the gathering device and the positioning member mounted on the support member at positions corresponding to and matching the size of the sheets. The sheet loading device is also characterized in that during sheet loading operation, the sheet receiving member cannot be placed out of the device and the sheet receiving member cannot be inserted into the device unless it is properly prepared.

9 Claims, 11 Drawing Sheets

SHEET LOADING DEVICE

This application is a continuation of application Ser. No. 616,705, filed June 4, 1984, now abandoned.

BACKGROUND OF THE INVENTION

1. Field of the Invention

This invention relates to a sheet loading device for causing sheets (cut sheets or paper leaves) put out one after another from a sheet output apparatus such as a laser beam printer or a copying apparatus onto a sheet receiving member to be loaded in orderly, mutually superposed relationship without being deviated from one another.

2. Description of the Prior Art

An apparatus such as a laser beam printer which puts out a great quantity of sheets generally has at the sheet output portion thereof a sheet loading device (a stacker) provided with sheet aligning mechanism.

FIG. 1 of the accompanying drawings is a perspective view showing the essential portions of an example of such device. Reference numerals 1 and 1 designate a pair of sheet discharge rollers provided on the side of a sheet output apparatus such as a laser beam printer, not shown, and reference numeral 2 denotes an output sheet supporting bed as a sheet receiving member disposed in front of the pair of sheet discharge rollers. Sheets P are discharged one after another onto this supporting bed 2 and piled thereon. The supporting bed 2 is initially raised to a level slightly lower than the sheet output portion of the pair of sheet discharge rollers 1 and 1 by a vertically moving mechanism, not shown, and it is automatically lowered little by little as the piling of sheets progresses, and can support thereon a great quantity of sheets before it reaches its lowermost limit of downward movement.

The sheet aligning mechanism serves to bring the sheets discharged one after another onto the bed 2 into an orderly piled condition and comprises a pair of sheet guide bars 3 and 3 vertically disposed as discharged sheet front side positioning members on the front side of the sheet supporting bed 2, a pair of paddles 4 and 4 disposed between the pair of sheet guide bars 3 and 3, a sheet guide plate 5 vertically disposed as a discharged sheet left side positioning member on the left side of the sheet supporting bed 2 and parallel to the left side edge of the bed 2, and a putter 6 disposed on the right side of the sheet supporting bed 2. These members 3–6 are positioned and supported on an immovable member, not shown.

The sheet guide bars 3 and 3 and the sheet guide plate 5 are disposed in a relation in which a plane containing the sheet guide bars 3 and 3 and a plane containing the sheet guide surface of the sheet guide plate 5 intersect each other perpendicularly to each other.

Each of the paddles 4 comprises a rotary member 41 and a plurality of radially extending vane members 42 formed of a flexible material such as rubber sheet strips or the like and mounted around the rotary member 41, and may be rotatively driven in the direction of arrow by a motor 43 through a shaft 44, whereby the vane members 42 are rotated in friction contact with the upper surface of the piled sheets on the bed 2 in such a manner that they strike said upper surface, and thus, a gathering force toward the sheet guide bars 3 and 3 acts on the uppermost one of the piled sheets on the bed 2.

The putter 6 swings to right and left about a vertical shaft 62 with the intermittent supply of power to an electromagnetic solenoid-plunger 61 and strikes the right side edge of the piled sheets P on the bed 2, whereby a gathering force toward the sheet guide plate 5 acts on the piled sheets P on the bed 2.

Thus, the sheets P discharged one after another onto the bed 2 are positively gathered toward the sheet guide bars 3 and 3 which are the sheet front side positioning members by the paddles 4 and 4 and the front side of the sheets strikes against the sheet guide bars 3 and 3 and the sheets become positioned thereby. Also, the sheets are positively gathered toward the sheet guide plate 5 which is the sheet left side positioning member by the putter 6 and the left side of the sheets strikes against the surface of the sheet guide plate 5 and the sheets become positioned thereby. Thus, the individual discharged sheets P are piled on the bed 2 in orderly, mutually superposed relationship with the sheet guide bars 3, 3 and the sheet guide plate 5 as the sheet front side and left side positioning members.

Now, to enable the above-described sheet loading device to be used correspondingly with various sheet sizes, the sheet guide plate 5 which is the sheet left side positioning member may be fixed, but the sheet guide bars 3, 3 which are the sheet front side positioning members, the paddles 4, 4 and the putter 6 must be designed to be movable and adjustable in position. However, the entire device becomes complicated and its operability is poor when the members 3, 3, 4, 4 and 6 are designed to be movable in two different directions and adjustable in selected positions.

Also, the loading device of this type has heretofore been constructed as follows:

(1) The output sheets are loaded onto the pallet;

(2) The pallet is vertically movable by a lift device to keep the supporting surface constant;

(3) When a predetermined quantity of sheets has been loaded, the lift device is lowered to its lowermost limit;

(4) That condition is a condition in which the sheets and the pallet have become contained in the container; and (5) The container is installed on a bed which can be drawn out, and the bed may be drawn out and the container with the sheets and the pallet contained therein may be removed and carried.

Such construction has led to the undesirable possibility that during sheet loading operation, the bed may be drawn out by mistake and the sheets become jammed. Also, the container must be set on the bed while containing the pallet therein, but when the operator forgets to place the pallet into the container, the sheets may again become jammed and this has sometimes led to the undesirable possibility of damaging the device.

SUMMARY OF THE INVENTION

It is an object of the present invention to enable discharged sheets to be reliably and properly aligned in a sheet loading device provided with a sheet receiving member for supporting thereon the discharged sheets in mutually superposed relationship.

It is a further object of the present invention to provide a sheet loading device in which the position of a sheet aligning mechanism relative to the sheet receiving member may be changed corresponding to the size of the sheets to enable the sheet loading device to be used correspondingly to various sheet sizes and which is simple in construction and excellent in operability.

It is still a further object of the present invention to prevent the jamming by malfunctioning or the damaging of the device which has been a problem peculiar to the prior art.

The present invention is characterized in that a sheet positioning member constituting the sheet aligning mechanism and means for frictionally contacting the upper surface of the sheets piled on the sheet receiving member and gathering the sheets toward the sheet positioning member are mounted and supported on a member which is free to reciprocally move and position and the support member is moved in accordance with the size of the sheets put out onto the sheet receiving member to position the sheet aligning mechanism mounted and supported on said member at a position corresponding to and matching the size of the sheet.

According to this feature of the present invention, positional adjustment of the sheet aligning mechanism corresponding to various sheet sizes may be effected in one direction X-X' and therefore, the construction of the mechanism becomes simple and the device is excellent in operability and practical and thus effectively can achieve its intended purposes.

Also, the present invention is characterized in that in a sheet loading device for loading discharged sheets in mutually superposed relationship, a locking mechanism is provided on a bed which can be drawn out and the bed is pushed in only when the container and the pallet have been set in predetermined states and during sheet loading operation, the bed cannot be drawn out.

According to this feature of the present invention, when the container and the pallet are to be set on the bed, every malfunctioning can be prevented and also, the malfunctioning of drawing out the bed during loading can be prevented and thus, the jamming of sheets or the damaging of the device which is attributable to such malfunctioning can be prevented. Accordingly, further, the container and the pallet are always in proper positions and therefore, the intended purpose of properly aligning the sheets can also be achieved.

The invention will become more fully apparent from the following detailed description thereof taken in conjunction with the accompanying drawings.

BRIEF DESCRIPTION OF THE DRAWINGS

FIG. 14 is a side cross-sectional view of the locking mechanism when the bed is pushed in.

DESCRIPTION OF THE PREFERRED EMBODIMENTS

Figure 1:
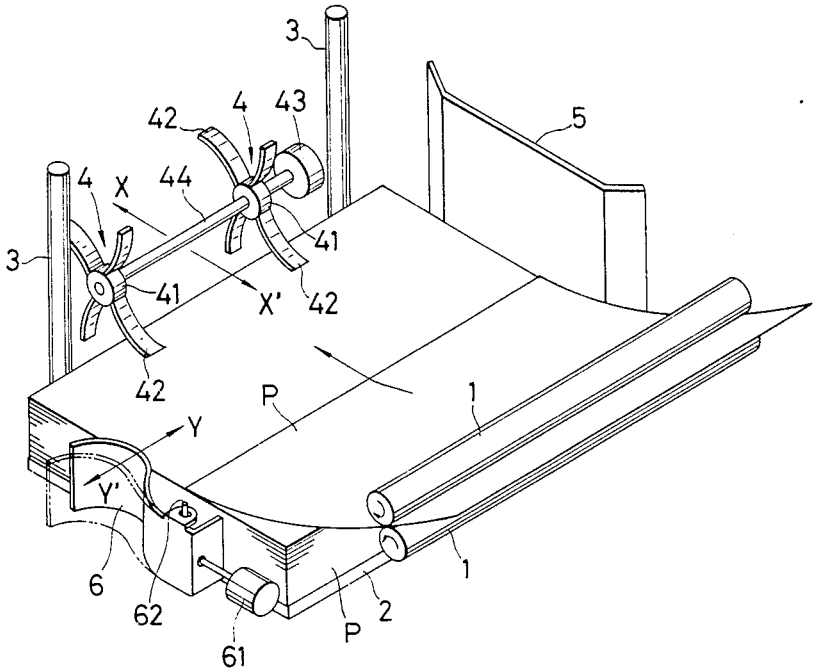
FIG. 1 PRIOR ART
FIG. 1 is a perspective view showing the essential portions of the device according to the prior art.
Figure 2:
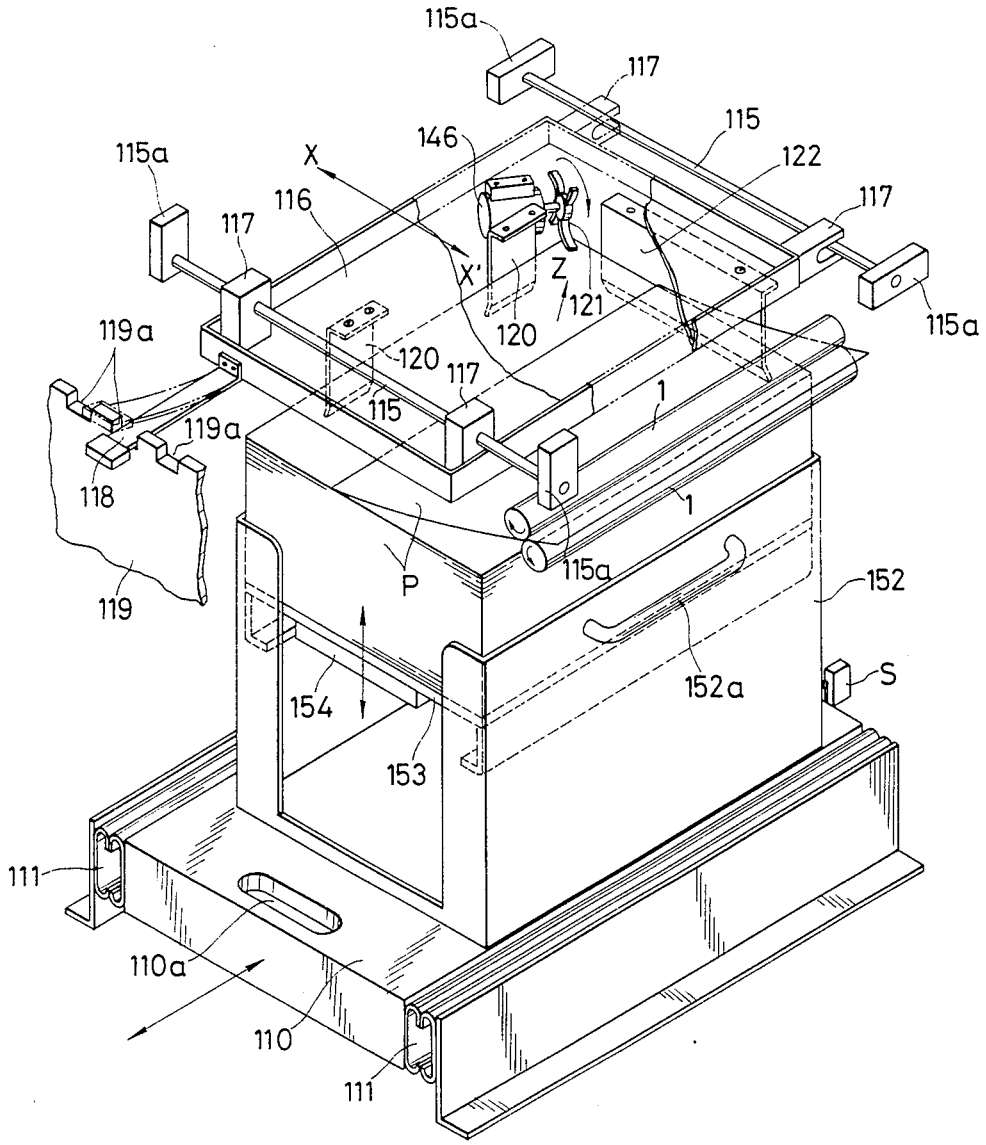
FIG. 2 is a partly cut-away perspective view of an embodiment of the device of the present invention.

FIG. 2 shows an embodiment of the present invention. In FIG. 2, reference numeral 110 designates a supporting bed which can be moved in and out axially of a pair of sheet discharge rollers 1 and 1 by slide rails 111 and 111. Denoted by 152 is a container positioned and supported on the bed 110. The placement of the container 152 onto the bed 110 may be accomplished by drawing out the bed 110 toward this side, and then sufficiently pushing back the bed 110 into the apparatus until it is stopped by a stopper member (not shown), whereupon the container 152 on the bed 110 is moved to the front of the pair of sheet discharge rollers 1 and 1 and is positioned thereat. Letter S designates a sensor adapted to be switched on by being pushed by the moved container 152 and detects that the container 152 is present in the device. Reference numeral 153 designates a movable pallet contained in the container 152. The pallet 153 is a member corresponding to the sheet supporting bed 2 shown in FIG. 1 and is vertically moved with its underside supported by a lift member 154 vertically moved by a vertically moving mechanism, not shown.

Reference numerals 115 and 115 denote a pair of horizontal, parallel rail members disposed above the container 152 in the device and above the pair of sheet discharge rollers 1 and 1 and extending in the forward and backward direction (X–X'), reference character 115*a* designates support members for supporting the opposite ends of each of the rail members, and reference numeral 116 denotes a sheet aligning mechanism mounting board mounted to and supported by the rail members through slide locks 117. Accordingly, the board 116 is slidable back and forth along the rail members 115 and 115. Reference numeral 118 designates a handle formed of a plate spring having its base secured to the board 116 to operate the board, and reference numeral 119 denotes a handle restraining comb-tooth plate formed with a plurality of recesses 119*a* in which the handle 118 may fit. The handle 118 formed of a plate spring may be disengaged from a recess 119*a* of the comb-tooth plate 119 by being slightly upwardly flexed as indicated by dots-and-dash lines against the resiliency thereof to thereby operate and move the board 116, and the handle 118 may be again engaged with a recess 119*a* at the required position to thereby position the board 116.

Reference numerals 120, 120, 121 and 122 designate sheet front side positioning members, a paddle and a sheet left side positioning member, respectively, as the components of the sheet aligning mechanism. These members correspond to the members 3, 3, 4, 4 and 5 in the device of FIG. 1, and are mounted and supported in predetermined positional relations to the underside of the board 116 as by screws.

The paddle 121, unlike the paddle shown in FIG. 1, has its axis of rotation disposed in the corner at which a plane containing the sheet front side positioning members 120 and 120 intersects a plane containing the surface of the sheet left side positioning member 122 obliquely with respect to the plane containing the sheet front side positioning members 120 and 120. By so disposing the paddle, a sheet discharged toward the pallet 153 which is the sheet supporting bed is subjected to a gathering force in an oblique direction Z toward the corner at which the plane containing the sheet front side positioning members 120 and 120 intersects the plane containing the surface of the sheet left side positioning member 122, by the paddle 121, and by the component of the gathering force in the oblique direction Z which is toward the members 120 and 120 and the component of said gathering force which is toward the member 122, the front side and left side of the sheet finally bear against the members 120, 120 and the member 122 and thus, the sheet is positioned. Accordingly, even if the putter 6 as shown in the apparatus of FIG. 1 is not disposed, there can be obtained a sheet aligning action similar to that of the FIG. 1 apparatus.

Thus, correspondingly to the size of the sheet P put out from the sheet output apparatus, the board 116 is moved along the rail members 115 and 115 by the handle 118 in the forward direction X in which the spacing between the pair of sheet discharge rollers 1, 1 and the sheet front side positioning members 120, 120 widens or in the backward direction X' in which said spacing narrows, whereby the position of the board 116 is adjusted. By this operation of moving the board 116, the sheet aligning mechanism 120, 120, 121, 122 integrally mounted and supported on the board 116 is also moved in the forward and backward direction X–X' and can be positioned at a position corresponding to the required sheet size, and that position is fixed by fitting the handle 118 into one of the restraining recesses 119*a*.

When it is detected by a sheet-amount sensor, not shown, that the loading of sheets onto the pallet 153 and the sequential downward movement of the pallet 153 progress and the amount of sheets loaded on the pallet has reached the maximum capacity of the container, a warming of fully loaded container is output by the detection signal. Alternatively, the operation of the present machine is automatically H) interrupted. Then, the lifter 154 lowers to its home position which is the lower limit of downward movement and the weight of the pallet 153 and of the sheets supported thereon shifts from the lifter 154 toward the bottom plate of the container 152 and thus, the pallet 153 is disconnected from the lifter 154. Also, the supporting bed 110 is unlocked.

Thus, by sufficiently drawing out the supporting bed 110 toward this side of the stacker device by utilization of a handle 110*a*, the container in which a great quantity of sheets is supported and contained is drawn out, and then is removed from the bed 110 by utilization of a handle 152*a* and carried to a required working station.

Even when the quantity of sheets supported on the pallet 153 is not the maximum capacity thereof, if a pallet-lowering switch, not shown, is depressed, the lifter 154 will lower to its home position and it will become possible to remove the container 152.

In the device of the above-described embodiment, the movement standard lines of sheets of various sizes are the left side of the sheets, but in a case where the right side of the sheets is the movement standard line, a sheet right side positioning member may be disposed instead of the sheet left side positioning member 122 and the paddle 121 may be disposed so as to rotate in contact with the upper surface of the right corner of the front side of a sheet.

The movement of the board 116, namely, the sheet aligning mechanism 120, 120, 121, 122, in the forward and backward direction X–X' need not always be effected by manual operation using the handle 118, but design may also be made such that said movement is accomplished by the drive of a motor or that said movement and positioning of the board is automatically accomplished in accordance with the sheet size information from the sheet output apparatus.

The container 152 may be interchanged correspondingly to the sizes of output sheets. The sheet supporting device itself may also be of the type in which the sheet supporting bed is fixedly disposed.

Figure 3:
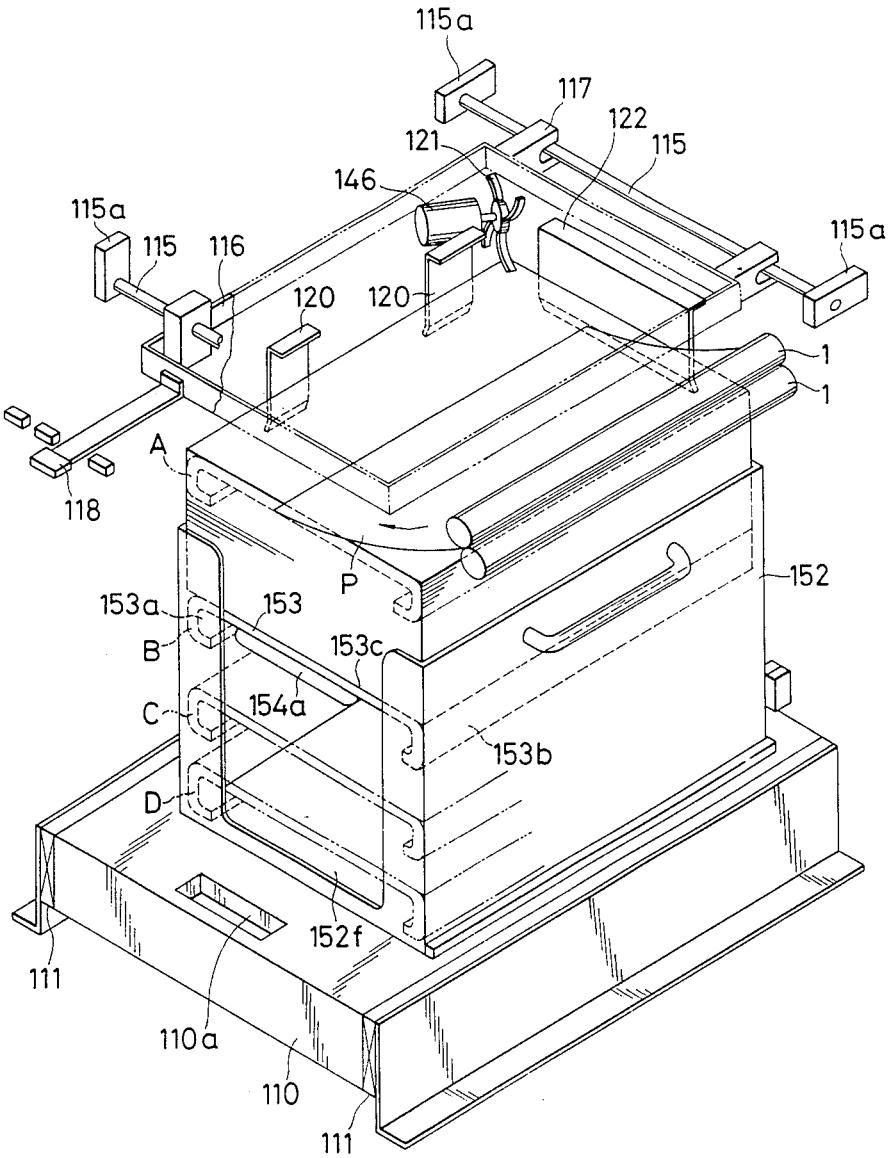
FIG. 3 is a perspective view for illustrating the operation of the pallet of FIG. 2.

FIG. 3 is a perspective view for explaining the upward and downward movements of the pallet 153 of FIG. 2.

The present device will be further described by reference to FIG. 3. The paddle 121 has its tip ends formed of an elastic material such as rubber and is rotated in the direction of arrow by the drive of a motor 146. This paddle 121 contacts the paper sheet P and draws the paper sheet P toward guides 120 and 122 by the friction force thereof with the paper sheet and aligns the paper sheet P. Also, the pallet 153 is of a U-shape having downwardly bent legs 153*a* and 153*b* and supports paper sheets P on the flat surface 153*c* thereof. Reference numeral 154 designates a lift device for keeping the level of the sheet supporting surface always constant. The lift device 154 is vertically movable along rails 160 (FIG. 4) by a motor (not shown).

Figure 4:
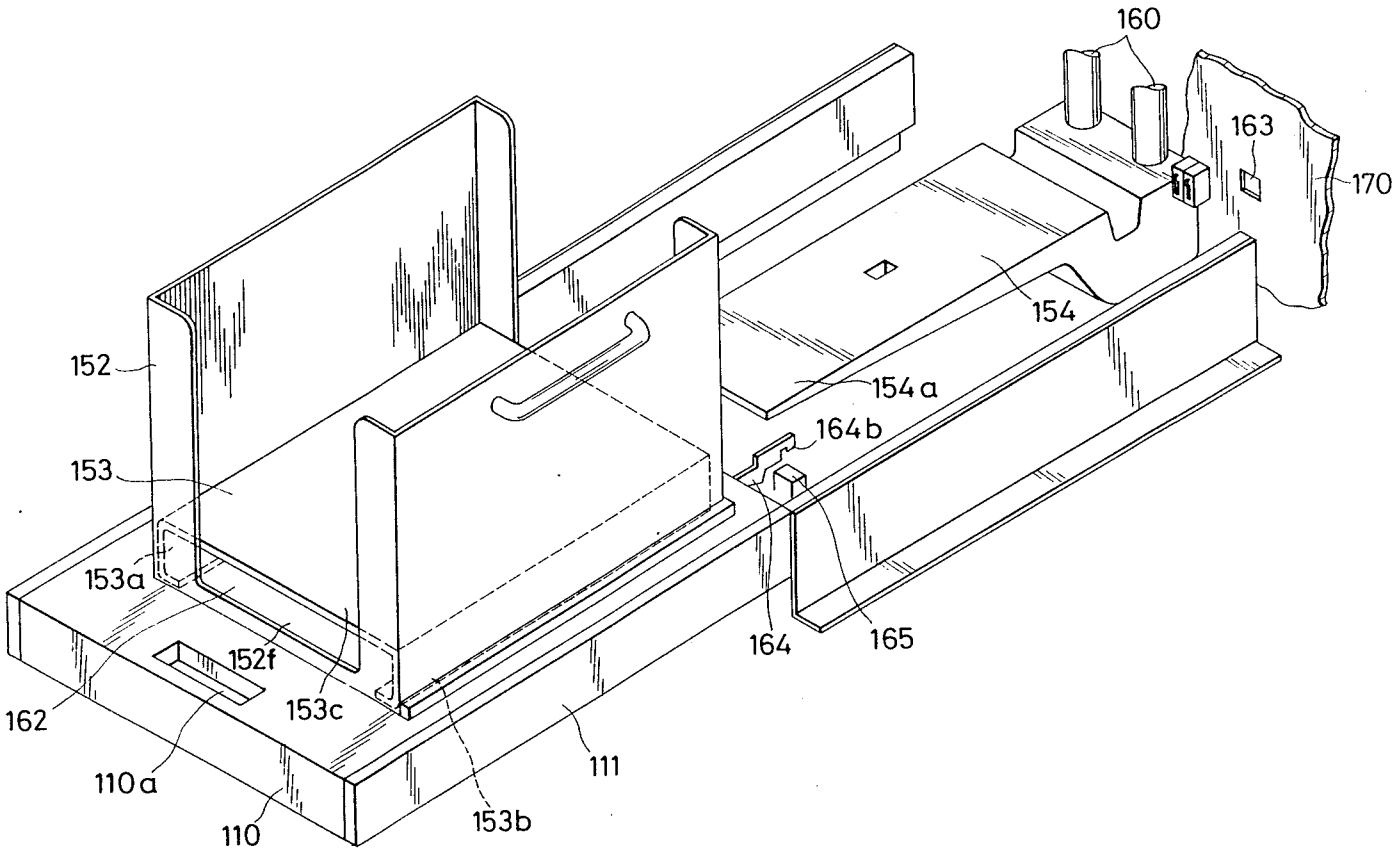
FIG. 4 is a perspective view showing a condition in which a bed has been drawn out.

FIG. 4 is a perspective view showing a condition in which the bed 110 has been drawn out from its predetermined loaded position by sliding the rails 111.

When the bed 110 is pushed in, it is positioned so that a fork 154*a* which is the fore end of the lift device 154 positioned at its lowermost limit enters the space 162 between the container 152 and the pallet 153 (between the bottom surface 152*f* of the container 152 and the flat surface 153*c* raised by the legs 153*a* and 153*b*). Reference numeral 163 designates a hole designed to be engaged by the tip end 164*b* of a detecting lever 164. Reference numeral 165 denotes a stopper designed to be engaged with the detecting lever 164 as will later be described in detail.

Figure 5:
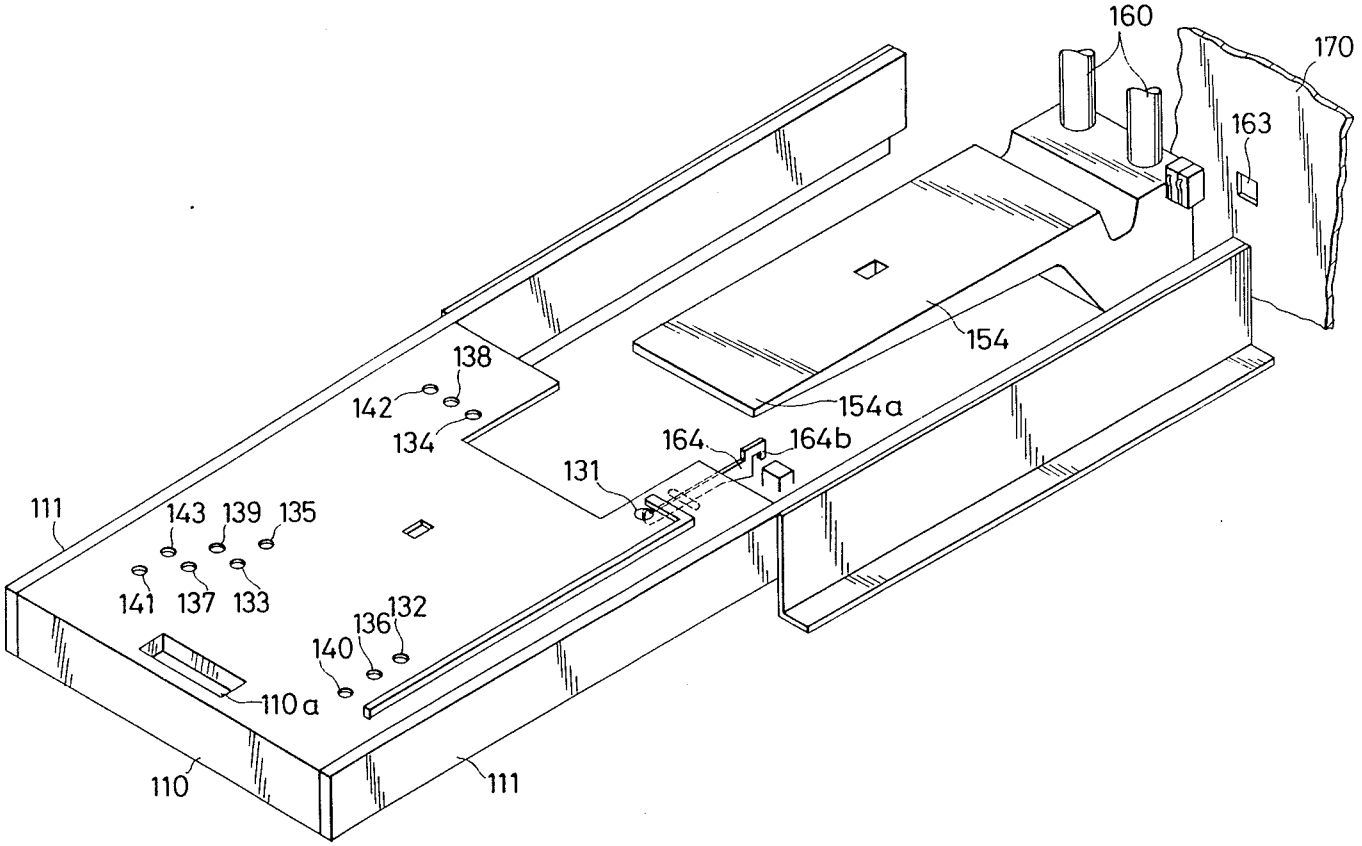
FIG. 5 is a perspective view showing the bed.

FIG. 5 is a perspective view showing a condition in which the container 152 and pallet 153 in FIG. 4 have been removed and also illustrating the bed 110.

In FIG. 5, apertures 131–143 are formed in the bed 110 and are used to install the container 152 at a predetermined location on the bed 110.

Figure 6:
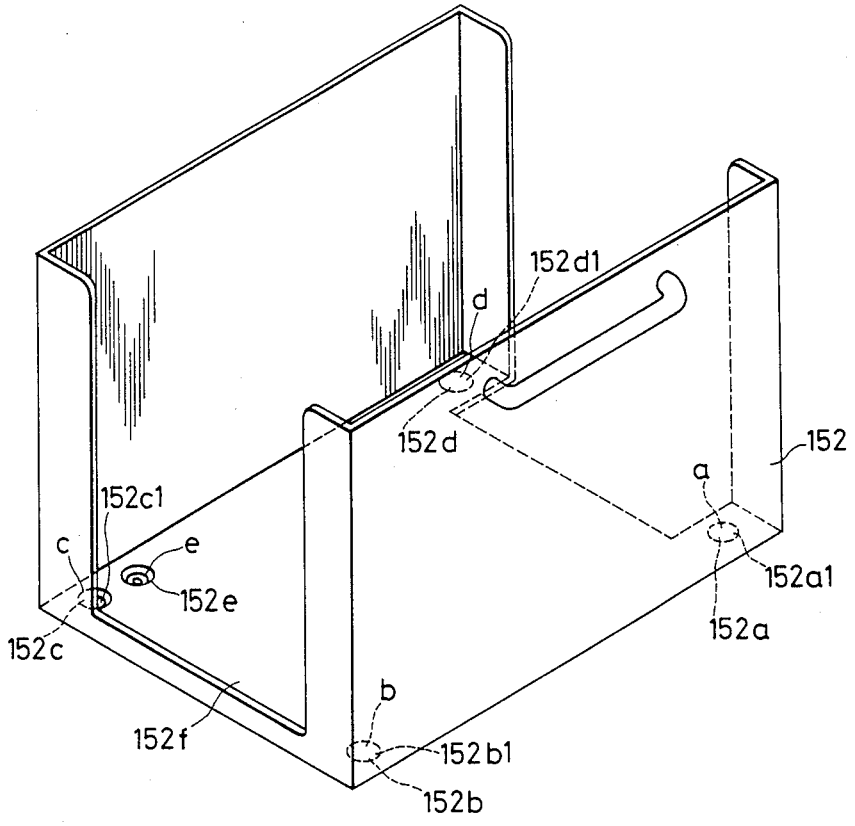
FIG. 6 is a perspective view showing a container.

FIG. 6 is a perspective view showing the container 152.

Positioning projections 152*a*, 152*b*, 152*c*. 152*d* and 152*e* are provided on the bottom surface 152*f* of the container 152. The projections 152*a* 152*d* are provided at the corners of the bottom surface 152*f* and the projection 152*e* is provided near the projection 152*c*.

Figure 7:
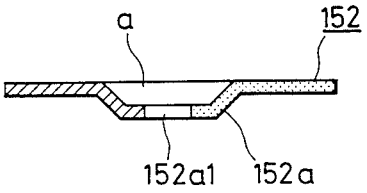
FIG. 7 is a cross-sectional view showing a projection of the container.

The shape of each projection is shown in FIG. 7. The projection 152*a* is illustrated as the representative in this Figure. An aperture 152*al* is formed at the center of the projection 152*a*. Likewise, apertures 152*bl*–152*dl* are formed centrally of the projections 152*b*–152*d* respectively. The projections 152*a*, 152*b*, 152*c*, 152*d* and 152*e* fit in the apertures 131, 136, 137, 138 and 139, respectively, formed in the bed 110, whereby the container 152 may be positioned on the bed 110. The apertures 132–135 and 140–143 of the bed 110 are formed as the apertures for a container corresponding to another paper size.

Figure 8:
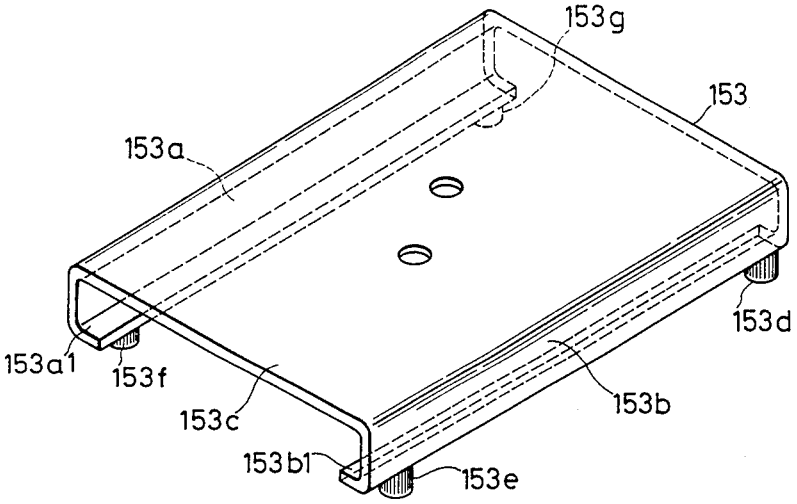
FIG. 8 is a perspective view showing a pallet.

FIG. 8 is a perspective view showing the pallet 153.

This pallet 153 is provided with positioning projections 153*d*, 153*e*, 153*f* and 153*g* at the bottom of the inwardly bent portions 153*al* and 153*bl* of the legs 153*a* and 153*b*. The projections 153*d*–153*g* fit in the downwardly facing recesses a–e of the projections 152*a*, 152*b*, 152*c* and 152*d* provided on the bottom surface 152*f* of the container 152, whereby the pallet 153 is positioned relative to the container 152. Also, this pallet 153 is point-symmetrical and can be set on the container 152 by being rotated by 180°.

Figure 9:
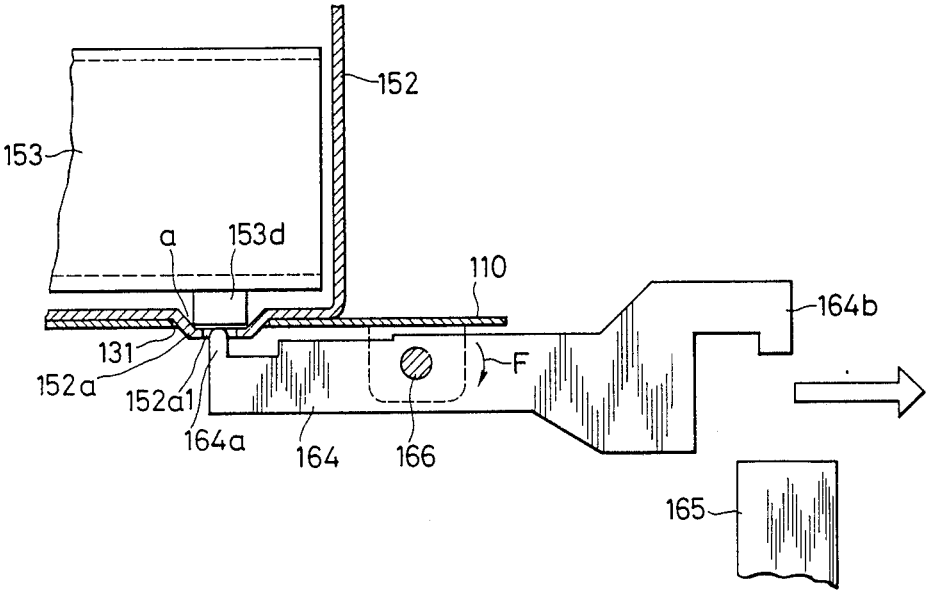
FIG. 9 is a side cross-sectional view the details of a locking mechanism.

FIG. 9 is a side cross-sectional view showing the details of a locking mechanism.

A detecting lever 164 as detecting means is hook-shaped as shown. The rear end 164*a* of the detecting lever 164 is in light contact with the projection 153*d* fitting in the recess of the container 152 and positioning the pallet 153 at a predetermined position relative to the container 152. This detecting lever 164 is pivotally mounted on a shaft 166 fixed to the bed 110, and a force which tends to rotate the detecting lever 164 in the direction of arrow F by the weight of the lever 164 itself is acting on the detecting lever 164. The container 152 is positioned at a predetermined position relative to the bed 110 by the projection 152*a* thereof fitting in the aperture 131 of the bed 110.

Operation of the sheet loading device having the above-described construction will now be described.

Description will first be made by reference to FIG. 3.

First, for example, a start button (not shown) is depressed and the pallet 153 is moved up to a position A by the use of the lift device 154. Paper sheets P put out one after another are placed onto the upper surface of the pallet 153. At this time, the lift device 154 lowers (to a position B indicated in FIG. 3) so as to keep the position of the supporting surface constant by a well-known technique. When the pallet 153 lowers to a position C indicated in FIG. 3 and supports paper sheets P thereon, a full load detecting mechanism, not shown, operates to stop the inputting of paper sheets thereafter and lowers the lift device 154 to its lowermost position. Thus, the pallet 153 comes to a position D indicated in FIG. 3 and the contact between the lift device 154 and the pallet 153 is released. Therefore, in this state, the bed 110 can be drawn out from its predetermined loaded position without any hindrance and the container 152 can be removed and carried.

Description will now be made of a case where the empty container 152 is set on the bed 110.

When, as shown in FIG. 9, the container 152 having the supporting bed positioned at a predetermined position by the projections 153*d*–153*g* fitting H' in the recesses a–d of the container 152 is positioned at a predetermined position on the bed 110 by the projections 152*a*–152*d* thereof fitting in the apertures 131–134 of the bed 110, the projection 153*d* of the pallet 153 strikes the rear end 164*a* of the detecting lever 164 and the fore end 164*b* of the detecting lever 164 pivots counter-clockwise about the shaft 166 and comes out of contact with the stopper 165.

Accordingly, when the pallet and the container have been set normally, it becomes possible to push the bed 110 into its predetermined loaded position.

Figure 10:
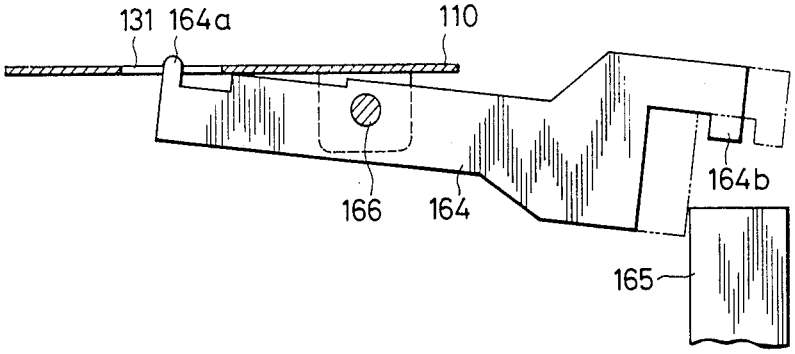
FIG. 10 is a side cross-sectional view of the locking mechanism when the container is not set.

FIG. 10 shows a case where the container 152 is not set on the bed 110. In this case, the fore end 164*b* of the detecting lever 164 pivots clockwise due to its own weight and, when it is displaced to push the bed 110 into its loaded position, the fore end of the detecting lever comes to bear against the stopper 165 (this state is indicated by dot-and-dash line).

Accordingly, if the container 152 is not set, the bed 110 cannot be pushed in and thus, malfunctioning can be prevented.

Figure 11:
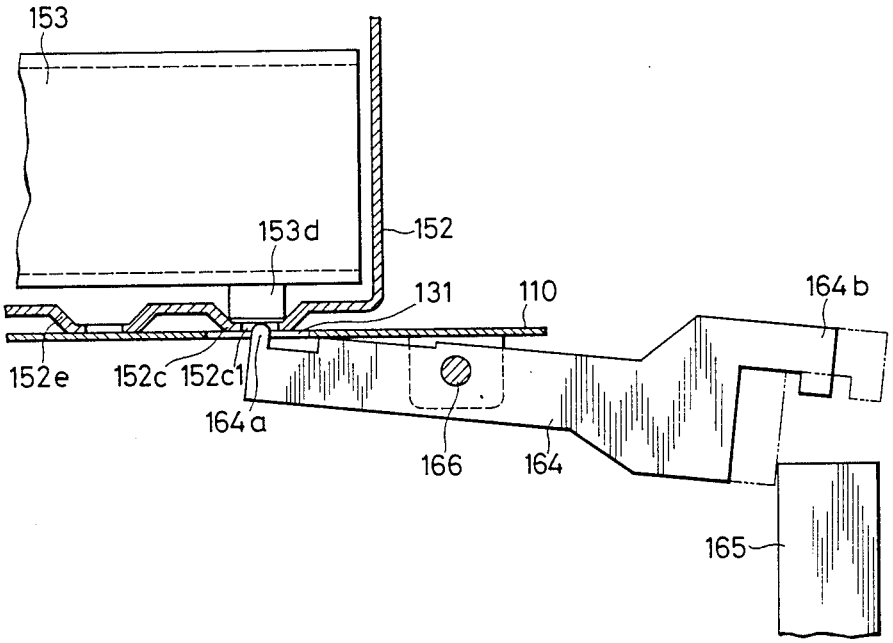
FIG. 11 is a side cross-sectional view of the locking mechanism when the container is invertedly set.

FIG. 11 shows a case where the container 152 has been set on the bed 110 in the reverse direction. In this case, the projections 152*a*, 152*b*, 152*c*, 152*d* and 152*e* of the container 152 are asymmetrically arranged and therefore cannot fit in the apertures 131, 136, 137, 138 and 139 of the bed 110. That is, as shown, for example, the projection 152*e* strikes against the bed 110. Accordingly, the container 152 floats up from the bed 110 and the projection 153*d* cannot push the rear end 164*a* of the lever 164 and thus, the detecting lever 164 comes into contact with the stopper 165.

Accordingly, where the container 152 has been set in the reverse direction, the bed 110 cannot be pushed into its predetermined loaded position and malfunctioning can be prevented.

Figure 12:
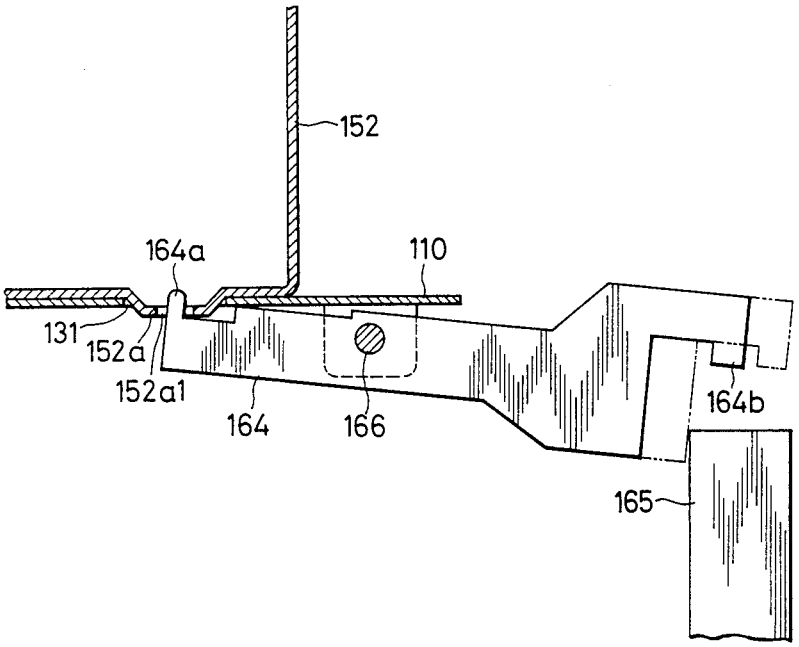
FIG. 12 is a side cross-sectional view of the looking mechanism when the pallet is not set.

FIG. 12 shows a case where only the container 152 is set on the bed 110 and the pallet 153 is not set. The rear end 164*a* of the lever 164 is not pressed and likewise, the bed 110 cannot be pushed in and thus, malfunctioning can be prevented.

Figure 13:
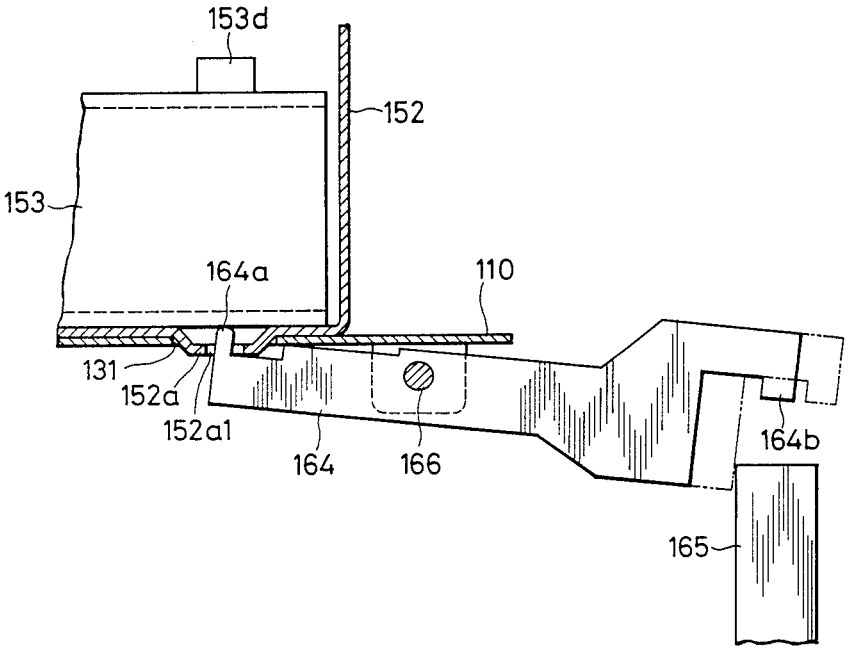
FIG. 13 is a side cross-sectional view of the locking mechanism when the pallet is reversely set.

Further, FIG. 13 is a side cross-sectional view showing a case where the pallet 153 has been set invertedly. Again in this case, the rear end 164*a* of the lever 164 is not pressed and likewise, the bed 110 cannot be pushed in and thus, malfunctioning can be prevented.

Figure 14:
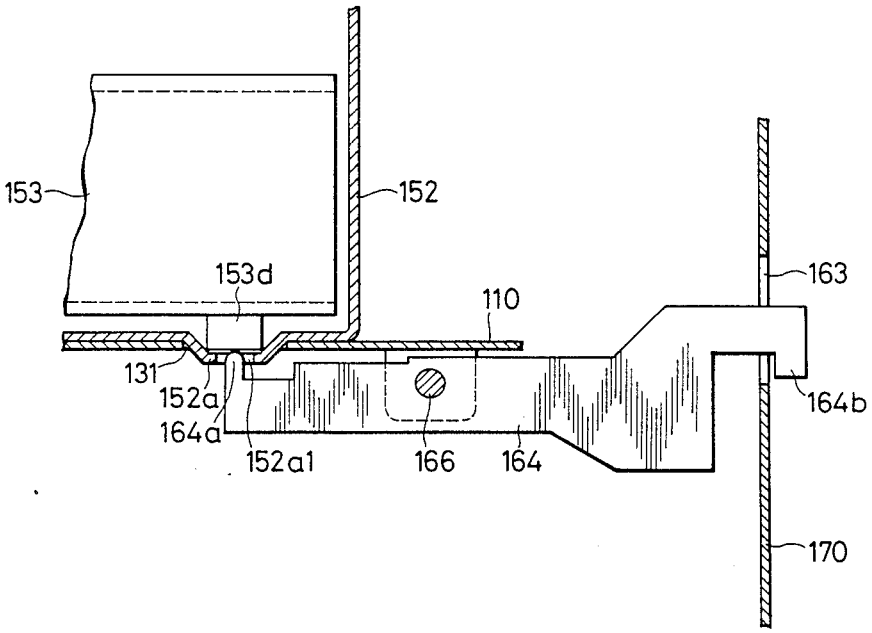

FIG. 14 is a side cross-sectional view showing a case where the container 152 and the pallet 153 have been set normally on the bed 110 and the bed 110 has been pushed into its predetermined loaded H; position The rear end 164*a* of the detecting lever 164 which has so far projected into the container 152 through the aperture 131 of the bed 110 and the aperture 152*al* of the projection 152*a* by its own weight is depressed by the projection 153*d* of the pallet 153, and the fore end 164*b* of the lever 164 pivots clockwise and comes into the aperture 163 of the rear side plate 170 of the body.

Figure 15:
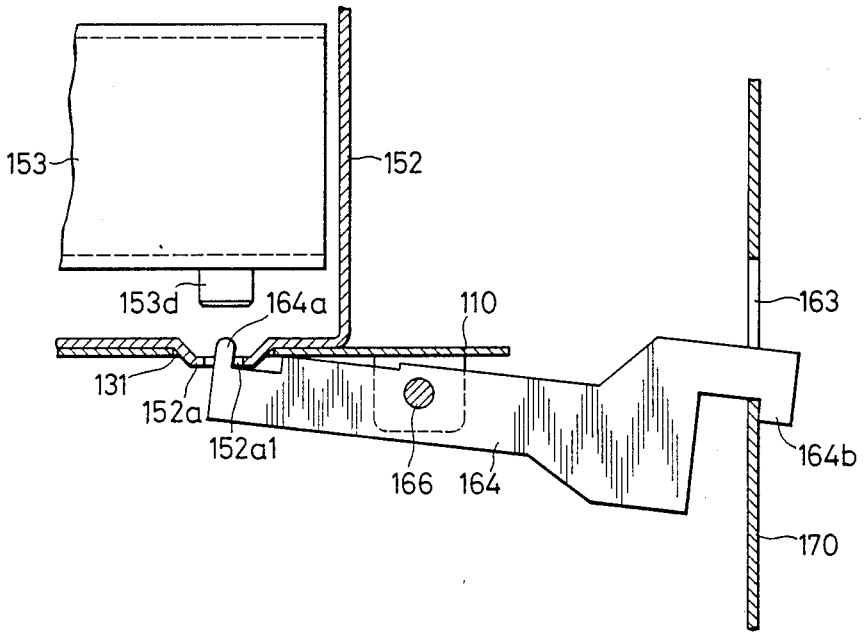
FIG. 15 is a side cross-sectional view of the locking mechanism when the pallet is elevated.

FIG. 15 is a side cross-sectional view showing a condition in which the pallet 153 has been elevated for the purpose of loading paper sheets thereonto.

Since the pallet 153 is elevated during paper sheet loading, the detecting leve r 164 pivots clockwise from its position shown in FIG. 14 by its own weight with the upward movement of the pallet 153 and the fore end 164*b* thereof comes into engagement with the aperture 163 of the rear side plate 170 of the body. Accordingly, the bed 110 cannot be drawn out during paper sheet loading and malfunctioning is prevented.

When the paper sheet loading is terminated and the pallet 153 lowers to its lowermost position, the state shown in FIG. 14 is restored and the bed 110 can be drawn out.

Figure 16:
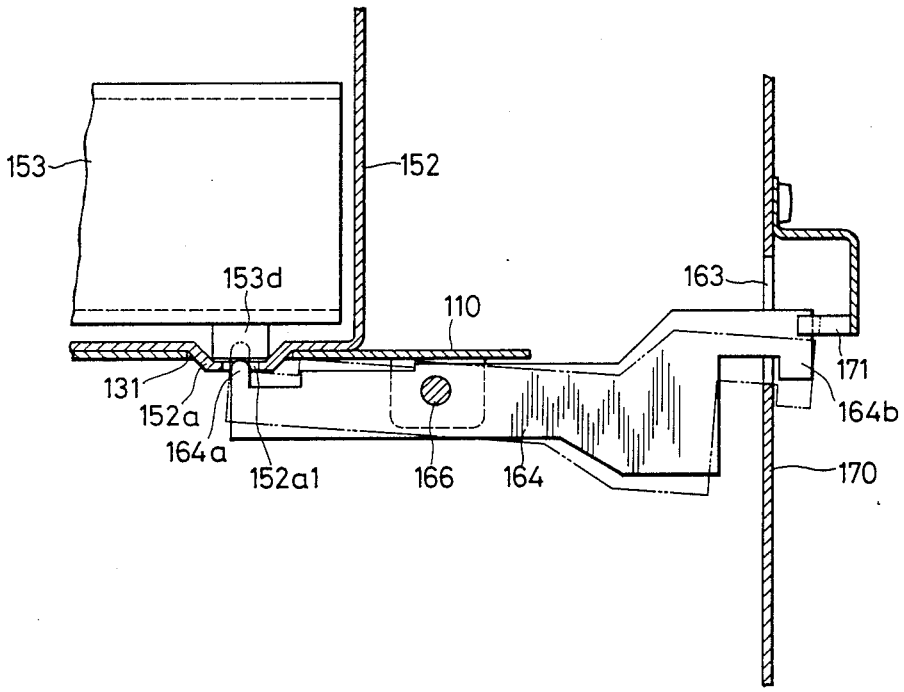
FIG. 16 is a side cross-sectional view showing another embodiment.

FIG. 16 is a side cross-sectional view of another embodiment showing a condition in which the bed 110 has been pushed in.

In the present embodiment, a photointerrupter 171 is attached to the rear side plate 170. When the container 152 and the pallet 153 are set in their regular state and the bed 110 is pushed into its predetermined loaded position, the detecting lever 164 interrupts the photointerrupter 171 and it is detected that the container and the pallet have been set normally. Thereafter, control is effected so that the lift device 154 moves up in response to the detection signal.

Accordingly, the set condition can be reliably detected. Also, when the lift device 154 is to be lowered after the paper sheet loading, control is effected so that the lift device 154 is stopped when the photointerrupter 170 detects the detecting lever 164 (the arrival of the detecting lever 164 at the solid-line position from the position indicated by dots-and-dash line is detected, thereby stopping the lift device).

In the present embodiment, as described above, the movement of the pallet 153 is directly detected and this leads to the possibility of accomplishing the most reliable detection.

The detecting means is not limited to the detecting lever shown in the embodiments, but may also be one constructed by utilization of a link mechanism, for example. The stopper member is neither limited to the stopper shown in the embodiments, but may be one which permits displacement of the bed when the detecting means detects that the container or the pallet has been mounted at a predetermined position, such as a member having a protrusion disengageably engaged with the recess of the detecting means. Further, the control means is not limited to the apertures shown in the embodiments, but may also be, for example, a member having a protrusion disengageably engaged with the recess of the detecting means.

We claim:

1. A sheet loading device having a sheet receiving member for supporting thereon discharged sheets in superposed relationship, said sheet receiving member comprising:

a supporting bed manually movable between a sheet discharging position in the device and a position away therefrom;

a container removably provided at a predetermined position on said supporting bed for containing the sheets, said container including first positioning means for positioning with respect to said supporting bed;

a pallet removably provided at a predetermined position in said container, saids sheets being stacked on said pallet, said pallet including second positioning means for positioning with respect to said container;

detecting means for detecting whether said first and second positioning means function correctly, said detecting means assuming an operable position when both said first and second positioning means function correctly and assuming an inoperable position when at least one of said first and second positioning means does not function correctly; and stopper means for permitting said supporting bed to be moved to said discharging position when said detecting means is in said operable position, and for preventing said supporting bed from being moved to said discharging position when said detecting means is in said inoperable position.

2. A sheet loading device according to claim 1, wherein said detecting means includes means retracted to a position out of engagement with said stopper means when said container and said pallet are correctly positioned.

3. A sheet loading device according to claim 2, wherein said detecting means includes a lever supported by said supporting bed, said stopper member is a member studded on a side of the device, and when said container and said pallet are correctly positioned, said pallet pushes on said lever to retract it.

4. A device according to claim 1, wherein said first positioning means comprises a first engaging portion formed on said container and engageable with a second engaging portion formed on said bed, said second positioning means comprises a third engaging portion formed on said pallet and engageable with a fourth engaging portion formed on said container, and said detecting means comprises a moving member which moves when said first engaging portion correctly engages with said second engaging portion and said third engaging portion correctly engages with said fourth engaging portion.

5. A device according to claim 4, wherein said first and third engaging portions are protrusions, and said second and fourth engaging portions are openings, and said moving member is a lever member pushed by said third engaging portion.

6. A sheet loading device having a sheet receiving member for supporting thereon discharged sheets in superposed relationship, said sheet receiving member comprising:

a container removably provided at a predetermined position on a supporting bed for containing the sheets;

a pallet removably provided at a predetermined position in said container, said sheets being stacked on an upper surface of said pallet;

a supporting bed on which said container is placed, said bed being manually movable into the device to a sheet discharging position and away therefrom;

detecting means for detecting whether or not said container is correctly located at a predetermined position on said supporting bed and whether or not said pallet is correctly located at a predetermined position in said container;

a stopper member for permitting said supporting bed to be moved into the device to said discharging position when said container and said pallet are correctly positioned but for preventing said supporting bed from being moved to said discharging position when at least one of said container and pallet is incorrectly positioned; and a preventing member for preventing said supporting bed from being moved away from said discharging position when said detecting means detects that said pallet is located at a position raised from its predetermined position.

7. A sheet loading device according to claim 6, wherein said detecting means includes means retracted to a position out of engagement with said stopper member when said container and said pallet are correctly positioned.

8. A sheet loading device according to claim 7, wherein said preventing member is disposed on the device and said detecting means engages with said preventing member when said supporting bed is moved to the discharging position and said pallet moves up and away from its predetermined position.

9. A sheet loading device according to claim 8, wherein said detecting means is a lever supported by said supporting bed, said lever being retracted from said stopper member by said pallet when said container and said pallet are supported at their predetermined positions and being engaged with said preventing member when said pallet is up and away from its predetermined position.

* * * * *

UNITED STATES PATENT AND TRADEMARK OFFICE

CERTIFICATE OF CORRECTION

PATENT NO. : 4,750,729

DATED : June 14, 1988

INVENTOR(S) : MASANOBU KANOTO, ET AL.

It is certified that error appears in the above-identified patent and that said Letters Patent is hereby corrected as shown below:

Column 3, line 22, "effectively can" should read --can effectively--;

line 59, "view the" should read --view showing the--;

line 65, "looking" should read --locking--.

Column 5, line 39, "warming of fully" should read --warning of a fully--;

line 41, "H)" should be deleted.

Column 6, line 53, "152c." should read --152c,--;

line 55, "152a 152d" should read --152a-152d--.

Column 7, line 52, "H'" should be deleted.

Column 8, line 34, "H; position" should read --position.--;

line 46, "leve r 164" should read --lever 164--.

UNITED STATES PATENT AND TRADEMARK OFFICE

CERTIFICATE OF CORRECTION

PATENT NO. : 4,750,729

DATED : June 14, 1988

INVENTOR(S) : MASANOBU KANOTO, ET AL.

It is certified that error appears in the above-identified patent and that said Letters Patent is hereby corrected as shown below:

Column 9, line 41, "saids" should read --said--.

Signed and Sealed this

Twenty-fifth Day of October, 1988

*Attest:*

DONALD J. QUIGG

*Attesting Officer*

*Commissioner of Patents and Trademarks*